United States Patent [19]

Greenwald

[11] 4,311,894

[45] Jan. 19, 1982

[54] SWITCH BUTTON CONSTRUCTION

[75] Inventor: Harry Greenwald, Whitestone, N.Y.

[73] Assignee: Greenwald Electro-Mechanical Consultants, Inc., Whitestone, N.Y.

[21] Appl. No.: 160,641

[22] Filed: Jun. 18, 1980

[51] Int. Cl.[3] ..... H01N 3/12; H01N 13/14

[52] U.S. Cl. ..... 200/340

[58] Field of Search ..... 200/333, 340, 332, 334, 200/153 T, 159 R, 335, 338, 330, 249, 259, 835

[56] References Cited

U.S. PATENT DOCUMENTS

| | | | |
|---|---|---|---|
| 631,892 | 8/1899 | Johnson | 200/340 |
| 664,667 | 12/1900 | Nathans | 200/340 |
| 4,094,396 | 6/1978 | Greenwald | 194/1 M |
| 4,127,758 | 11/1978 | Lowthorp | 200/340 |

FOREIGN PATENT DOCUMENTS

| | | | |
|---|---|---|---|
| 2023937 | 1/1980 | United Kingdom | 200/340 |

*Primary Examiner*—Willis Little

*Attorney, Agent, or Firm*—McAulay, Fields, Fisher, Goldstein & Nissen

[57] ABSTRACT

A pushbutton switch of the type wherein a pushbutton is depressed to operate a switch mechanism and which pushbutton is engaged and depressed by an adjustment screw extending through a moving device. The pushbutton includes a central contact portion which is engagable with the central end portion of the screw. A circumferential groove is disposed about the central contact portion of the pushbutton to provide clearance for the edge end portions of the screw so that the central end portion of the screw remains in contact with the central contact portion of the pushbutton. This relationship provides for precise adjustment of said screw in controlling the operation of the switch mechanism.

4 Claims, 7 Drawing Figures

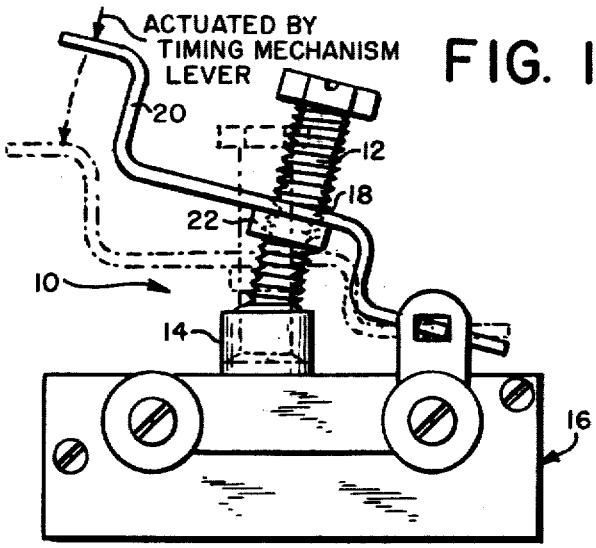
FIG. 1.
FIG. 2.
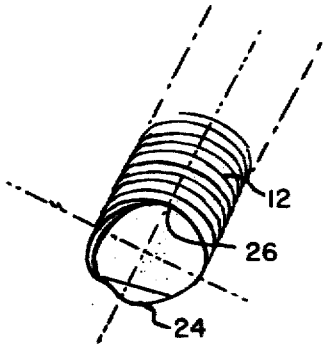
FIG. 3.
PRIOR ART
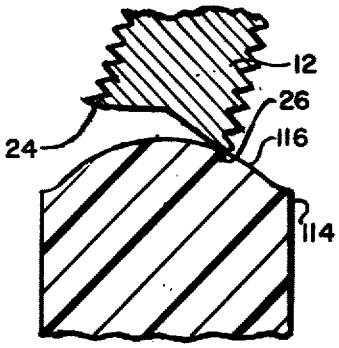
FIG. 4.
PRIOR ART
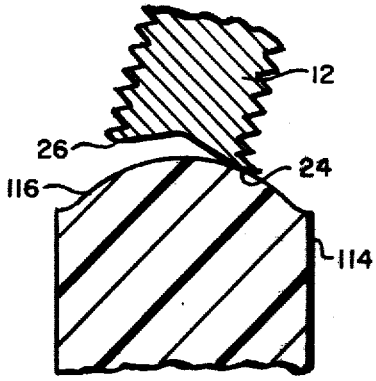
FIG. 5.
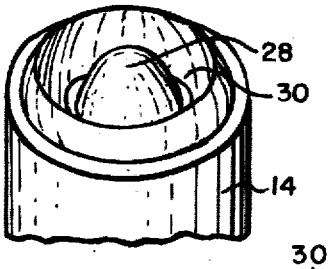
FIG. 6.
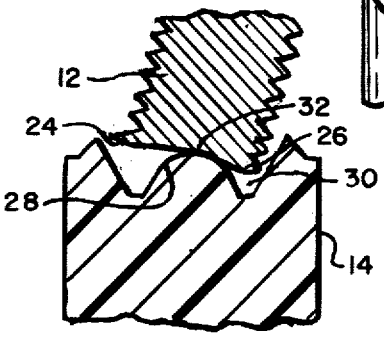
FIG. 7.
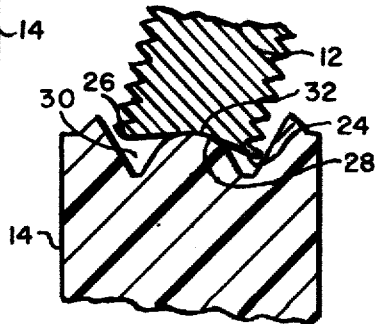

SWITCH BUTTON CONSTRUCTION

BACKGROUND OF THE INVENTION

1. Field of the Invention

This invention relates generally to the pushbutton of a switch which is to be operated by an adjustably positioned screw and, more particularly, to a pushbutton design which engages the central portion of the adjusting screw thereby to provide more precise adjustment control.

2. Description of the Prior Art

The present invention is essentially a new button construction for a switch to be operated by a mechanical device wherein the final linkage is an adjusting screw which engages the end of the button to operate the switch. In mechanical switching devices, especially where a number of gears are involved in the switching action, adjustment of the switch activator to activate the switch over a particular portion of the operating cycle is accomplished by use of an adjustably positioned threaded screw. An example of such an arrangement is shown in U.S. Pat. No. 4,094,396 to Greenwald.

The device in U.S. Pat. No. 4,094,396 is a control device for a coin-operated mechanism such as would be used to control the duration of the operating cycle of automatic coin-operated clothes washers and dryers. Timing control allows adjustment of the effective cost of operating the mechanism by controlling the duration of the operating cycle. In order to control the timing cycle of the control device, an arrangement in the form of an adjusting screw passes through a tapped hole in a pivotally mounted lever arm to engage the pushbutton of a snap-action switch. The lever arm is moved by a ratchet wheel arrangement which, in turn, is driven by a timing mechanism. By rotating the screw in its tapped hole or socket, fine adjustment of the actuation of the switch by the timing device is accomplished.

The adjustment screw is typically one formed by rolling a thread on a screw blank. This results in a screw which has an uneven end edge with discontinuities of at least 5/1000ths of an inch. This is inherent in the manufacturing process. Because of the uneven end, contact between the screw and the top of the pushbutton changes from position to position on both the end of the screw and the pushbutton, and can change the time adjustment in a discontinuous manner by at least 4–5 minutes in a typical mechanism. In a timing cycle of sixty minutes, a variation of 4 minutes is substantial and undesirable.

It is therefore an object of the present invention to provide an engagement structure to avoid the disadvantages of the prior art and provide more precise adjustability of the switching structure.

BRIEF DESCRIPTION OF THE DISCLOSURE

Briefly, the present invention provides for the pushbutton to be formed having a depression in the head or crown portion thereof and a raised portion rising from the center of the depression. The result is a pushbutton which is formed having a central engagement portion that contacts the central end portion of the adjusting screw to maintain constant contact of said central portions irrespective of the rotation of the screw. In other words, when the screw is adjustably positioned by rotating it in its tapped socket, the point of contact with the pushbutton does not vary substantially. Since the irregularities in the end of the screw do not contact the pushbutton, precise adjustment of the switching arrangement is made possible.

BRIEF DESCRIPTION OF THE DRAWINGS

In the drawings:

FIG. 1 is an elevational view of the pushbutton of the present invention employed in a switching arrangement, and wherein the phantom line drawing illustrates inward movement of the pushbutton to operate the switch;

FIG. 2 is a perspective view showing the end of a typical adjustment screw;

FIG. 3 and FIG. 4 show the usual prior art engagement of the adjusting screw and pushbutton as the adjusting screw is rotated;

FIG. 5 is a perspective view of the end of a pushbutton showing the preferred structure according to the present invention; and FIGS. 6 and 7 are similar to FIGS. 3 and 4 except illustrating engagement of the adjusting screw with the pushbutton constructed according to the present invention.

DESCRIPTION OF THE PREFERRED EMBODIMENT

As illustrated in FIG. 1, the switching structure 10 of the present invention is for use in a switch operating mechanism such as shown in U.S. Pat. No. 4,094,396 wherein an adjusting screw 12 engages the pushbutton 14 of a switch 16 to move the pushbutton 14 and operate the switch 16. Adjusting screw 12 passes through a threaded socket 18 formed in a lever 20 which, in turn, is actuated by a timing mechanism or other moving device. Screw 12 is retained in its adjusted position by means of locking nut 22.

As illustrated by the phantom line representation in FIG. 1, when the lever 20 moves toward the switch 16, the button 14 is pushed inwardly to operate the switch. Turning screw 12 in threaded socket 18 will cause it to move toward or away from pushbutton 14 thereby controlling the time at which the pushbutton 14 will be pushed fully home to operate switch 16 upon movement of lever 20. A more complete description of the switch operating mechanism forming part of a control device for coin-operated mechanism is disclosed in U.S. Pat. No. 4,094,396 noted above.

Unfortunately, readily available threaded screws 12 for use as adjusting screws do not have perfectly shaped ends. Referring to FIGS. 2, 3 and 4, one end edge of screw 12 is normally formed having a raised irregular lip 24 while the opposed edge is somewhat depressed as represented by numeral 26. As discussed briefly above, this is inherent in the process by which the screws are manufactured. Furthermore, referring to FIGS. 3 and 4, the pushbuttons 114 representative of the prior art are formed with a concavely shaped head or crown 116. Therefore, the engagement of screw 12 with pushbutton 114 is such that as screw 12 is rotated to adjust its position in lever 20, the point of contact of the end of the screw with the head of the pushbutton changes and varies between the lip edge 24 and the opposed depressed edge 26. That is, the point of contact of said members does not remain constant upon rotation of the screw. The result is that the amount of adjustment obtained by rotation of the screw 12 does not vary linearly with the position of the screw. To one adjusting the device by rotation of the screw, it is difficult to achieve a precise adjustment due to the non-linear adjustment characteristic inherent in the structure representative of the prior art.

In order to avoid the problem of the prior art, a unique switch pushbutton 14 structure is provided as shown in FIGS. 5, 6 and 7. Pushbutton 14 is formed having a raised central contact portion 28 surrounded by a circumferential groove 30. With this structure, it is the central end portion 32 of the screw 12 which is substantially in constant contact with the central portion 28 of pushbutton 14. That is, substantially the same portion of the screw is always in contact with substantially the same portion of the pushbutton, irrespective of the rotational orientation of the screw. This avoids the non-linear adjustment characteristics associated with the prior art pushbuttons and enables one to obtain precise adjustment of the timing device. Circumferential groove 30 provides clearance for the irregular lip 24 of screw 12. It is also preferably sized to closely contain the irregular lip 24, as shown in FIGS. 6 and 7, thereby to restrain excessive relative lateral movement between the screw 12 and the contact portion 28 of the pushbutton 14, which might otherwise cause disengagement of the screw 12 from the pushbutton 14. Such lateral movement might be caused, for example, by someone trying to defeat the timing mechanism by violently jarring it.

The raised central portion 28 is illustrated with a generally rounded conical shape. Other similar shapes can be substituted, for example, one having a pointed top. However, the rounded shape illustrated in the drawings is preferred because it is less severely altered by wearing down during use, and it can easily be formed by converting prior art buttons by cutting with a circular grinder. If the buttons are to be formed by molding the shape directly, the slightly rounded shape is easier to form and more robust.

While a preferred embodiment of the invention has been shown and described in detail, it will be readily understood and appreciated that numerous omissions, changes and additions may be made without departing from the spirit and scope of the present invention.

What is claimed is:

1. In a pushbutton switch of the type wherein a pushbutton is depressed to operate a switch mechanism and which pushbutton is engaged and depressed by an adjustment screw extending through a moving device, the improvement comprising: said pushbutton having a crown formed with a central contact portion engageable with the central end portion of the screw, said crown further having a circumferential groove disposed about said central contact portion, said central contact portion and said circumferential groove of said crown moving together relative to the switch when said pushbutton is depressed, said circumferential groove providing clearance for receiving the edge end portions of the screw when said pushbutton is depressed, whereby the central end portion of the screw remains in contact with the central contact portion of the pushbutton to permit precise adjustment of said screw in controlling the operation of the switch mechanism.

2. The switch of claim 1 wherein said circumferential groove is sized to receive and closely contain the edge end portion of the screw.

3. The structure of claim 1 wherein said central contact portion is substantially conical in shape.

4. The structure of claim 2 wherein the conical shape has a rounded top portion.

* * * * *